United States Patent [19]

Eriksson

[11] 3,963,127

[45]*June 15, 1976

[54] BLOCKING ARRANGEMENT IN HYDRAULICALLY OPERATED CRANES

[75] Inventor: Mats Erik Eriksson, Hudiksvall, Sweden

[73] Assignee: Hiab-Foco Aktiebolag, Hudisksvall, Sweden

[ * ] Notice: The portion of the term of this patent subsequent to Feb. 15, 1992, has been disclaimed.

[22] Filed: May 2, 1972

[21] Appl. No.: 249,564

[52] U.S. Cl. ..... 212/8 R; 212/39 MS; 212/55; 212/144; 91/388

[51] Int. Cl.[2] ..... B66C 13/48; B66C 23/06

[58] Field of Search ..... 212/30, 34, 35, 39, 212/59, 144, 55, 8, 39 R, 39 MS; 91/388, 412; 214/82, 38, 674

[56] References Cited

UNITED STATES PATENTS

| | | | |
|---|---|---|---|
| 3,007,593 | 11/1961 | Hancock | 214/674 |
| 3,035,710 | 5/1962 | Pohl | 212/39 R |
| 3,141,562 | 7/1964 | McAdams | 212/39 A |

FOREIGN PATENTS OR APPLICATIONS

| | | | |
|---|---|---|---|
| 1,238,170 | 4/1967 | Germany | 212/39 MS |

*Primary Examiner*—Albert J. Makay
*Attorney, Agent, or Firm*—Newton, Hopkins & Ormsby

[57] ABSTRACT

In hydraulically operated loading cranes, particularly loading cranes comprising multiple loading arms, a blocking device in the form of a return piston arranged, upon occurrence of an excessive pressure in the master cylinder, to prevent operation of piston-and-cylinder units actuating the loading arms in a direction away from the loading crane post but permit operation in the reverse direction, i.e. movement of the loading arms towards the post. The blocking device thus ensures that the moment of loading on the crane arms never reaches a value involving risks that the crane will tip over.

11 Claims, 7 Drawing Figures

III
III

BLOCKING ARRANGEMENT IN HYDRAULICALLY OPERATED CRANES

BACKGROUND OF THE INVENTION

In vehicle loading cranes it is important, from the point of view of work safety, that during loading the vehicle is not exposed to such a strong moment of lifting that the vehicle runs the risk of tipping over.

The present invention more particularly relates to an arrangement in hydraulically operated cranes of the type provided with a loading arm which is mounted on the crane post for swinging movement in a vertical plane relative to said post and is provided with a number of hydraulic piston-and-cylinder units by means of which it is possible to regulate the distance of the load supported in the crane arm to the crane supporting post.

The arrangement in accordance with the invention is particularly intended for use in hydraulic loading cranes of the type being provided with a multiple loading arm, e.g. consisting of one inner arm portion and one outer arm protion, which may be raised and lowered in a vertical plane, and with an extension arm, a so called projection arm, which may be displaced in the longitudinal direction of the loading arm. The hydraulic system of the crane comprises valves to operate the hydraulic piston-and-cylinder units effecting the movements of the two loading arm portions and the extension arm, respectively, and a valve controlled by the liquid pressure in the loading arm hydraulic cylinder, called the master cylinder. hitherto, this valve has been arranged, upon excess of a predetermined maximum liquid pressure in the master cylinder, to actuate the means operating the valves contrlling the liquid supply to and the liquid discharge from the master cylinder and the hydraulic cylinder for the extension of projection arm. A device of this kind is rather complicated and bulky and in addition, it has often proved not completely reliable in operation.

SUMMARY OF THE INVENTION

The purpose of the invention is to remedy the above drawbacks. This is obtained in accordance with the invention in that a piston, referred to as the return piston, is provided in an hydraulic cylinder for movement therein and adapted, upon exceeding of a predetermined maximum pressure in any one of the hydraulic piston-and-cylinder units to move any one of the operating valve pistons mounted one in each one of the lines to the respective cylinders, from a position wherein pressurized liquid may be forced into the cylinder associated with the operating piston in question in such a direction that the load suspended in the crane arm is moved away from the crane support post (i.e. an increase of the value of the moment of loading), to an intermediate position wherein the liquid supply to and/or from said cylinder is interrupted, but to permit the respective operating valve piston to be moved to an opposite position, wherein pressurized liquid may be forced into the associated cylinder but in the reverse direction to move the load in a direction towards the loading crane support post (i.e. a decrease of the value of the moment of loading).

In accordance with a preferred embodiment of the arrangement intended for use in hydraulic loading cranes of the multiple loading arm type with an extension or projection arm as described above, a displaceable piston, called the return piston, is arranged for movement in an hydraulic cylinder and adapted, upon exceeding of a predetermined maximum pressure in the master cylinder, to actuate said operating valve piston for any one of the crane sections, i.e. extension or projection arm, inner crane arm portion, or outer crane arm portion, to move said section from a position wherein pressurized liquid may be forced into the cylinder of the projection arm, the cylinder of the inner crane arm portion, or the cylinder of the outer crane arm portion in a direction to prolong the loading arm (i.e. increase of the valve of the moment of loading), to an intermediate position wherein the liquid supply line to and/or from the projecton arm cylinder, the inner crane arm portion cylinder, or outer crane arm portion cylinder is blocked but to permit the operating valve piston to be moved to an opposite end position wherein pressurized liquid may be forced into any one of said three cylinders but in a reverse direction to effect a shortening of the loading arm (i.e. decrease of the value of the moment of loading). Owing to this arrangement the construction may be made very compact with the return piston mounted in the same valve housing as the valve housing enclosing the respective operating valve piston.

The invention ensures that the maximum value of the moment of loading permitted for the crane is not exceeded through prolongation of the extension arm.

BRIEF DESCRIPTION OF THE DRAWINGS

Further characteristics of the invention will appear from the following detailed description with reference to the accompanying drawings. In the drawings.

DETAILED DESCRIPTION OF A PREFERRED EMBODIMENT

Figures 1, 2:
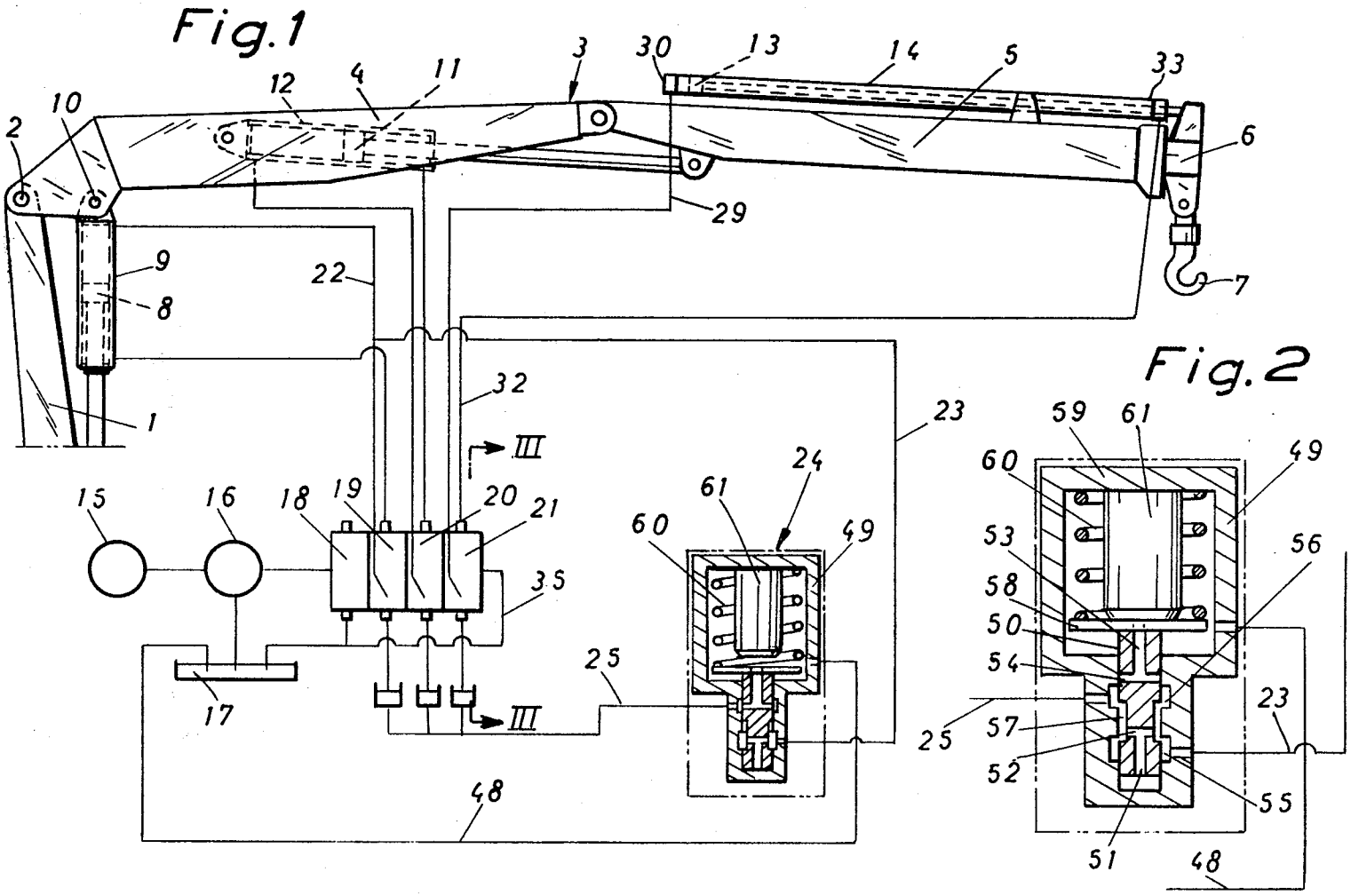
FIG. 1 illustrates diagrammatically a side view of a crane incorporating a valve arrangement in accordance with the invention.
FIG. 2 illustrates on an enlarged scale a vertical section through a two-way valve incorporated in the hydraulic system, the valve piston being in the opposite end position to the one illustrated in FIG. 1.

In the support (not shown) of the crane illustrated in FIG. 1 is rotatably mounted a post 1 at the upper end of which a loading boom 3 is rotatably mounted about a shaft 2. The loading boom 3 consists of two arm portions, an inner arm portion 4 to which is hingedly connected an outer arm portion 5. An extension or prolongation arm 6 is mounted on the outer arm portion 5 so as to be prolonged in the direction of extension of said arm. The outer extremity of the arm 6 supports a lifting hook 7 or other lifting tool. An hydraulic piston-and-cylinder unit (not shown) is provided to bring about turning movement of the post 1 about its longitudinal axis. An hydraulic piston-and-cylinder unit 8, 9, the cylinder of which is denominated the master cylinder, and a transverse shaft 10 which is hingedly connected to the inner arm portion 4, are arranged to permit the loading boom 3 to be swung upwards or downwards, and a second hydraulic piston-and-cylinder unit 11, 12 brings about the swinging movements of the outer arm portion 5. A third hydraulic piston-and-cylinder unit 13, 14 permits displacement of the extension arm 6 inwards and outwards for prolongation or shortening, respectively, of said arm.

From a pump 16 driven by a motor 15 oil is carried from a collection reservoir 17 over the respective operating valves 18, 19, 20, and 21 to and from the hydraulic piston-and-cylinder unit (not illustrated) for effecting the turning movement of the post 1, the master cylinder 9, the cylinder 12, and the cylinder 14, respectively. In the line 22 to the upper end of the master cylinder 9 is through a line 23 connected a two-way valve 24 which by means of a line 25 is connected to a cylinder 26 at one end of the valve housing 27 of the respective operating valves 19, 20, 21, in which housing the operating piston 28 of each valve is axially displaceable.

Figure 3:
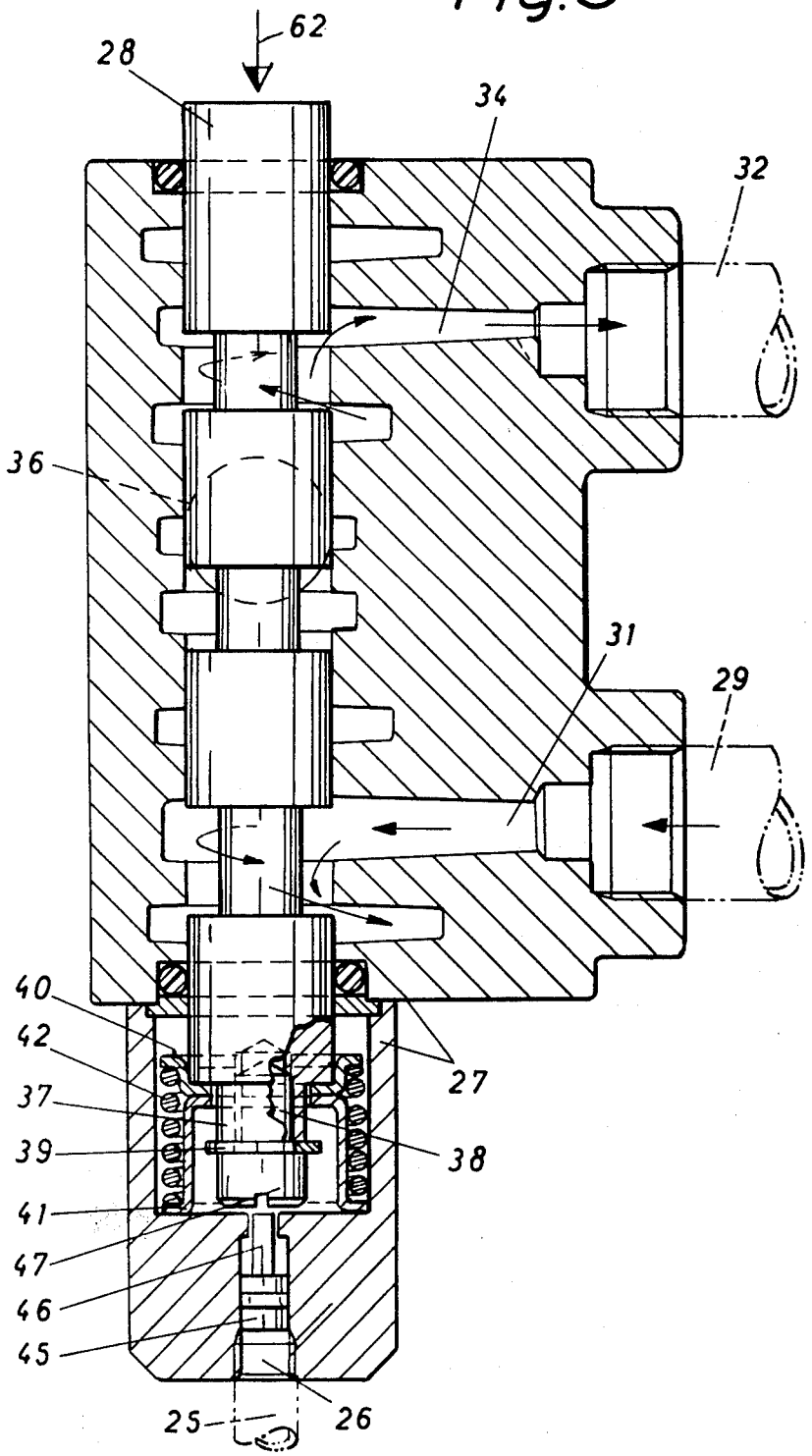
FIGS. 3, 4, and 5 are longitudinal sections along line III—III of FIG. 1 through the extension arm operating valve being provided with an arrangement in accordance with the invention and they illustrate the operating valve piston in three different positions.
Figure 4:
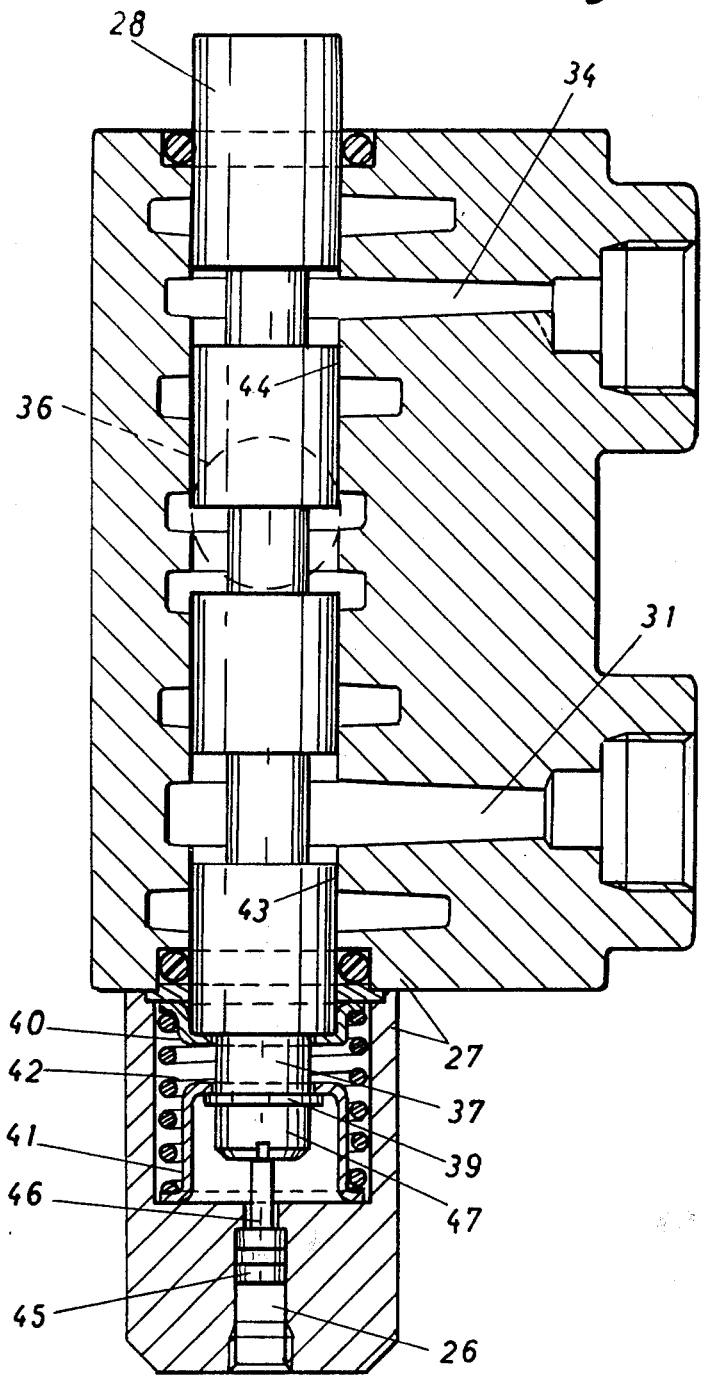
Figure 5:
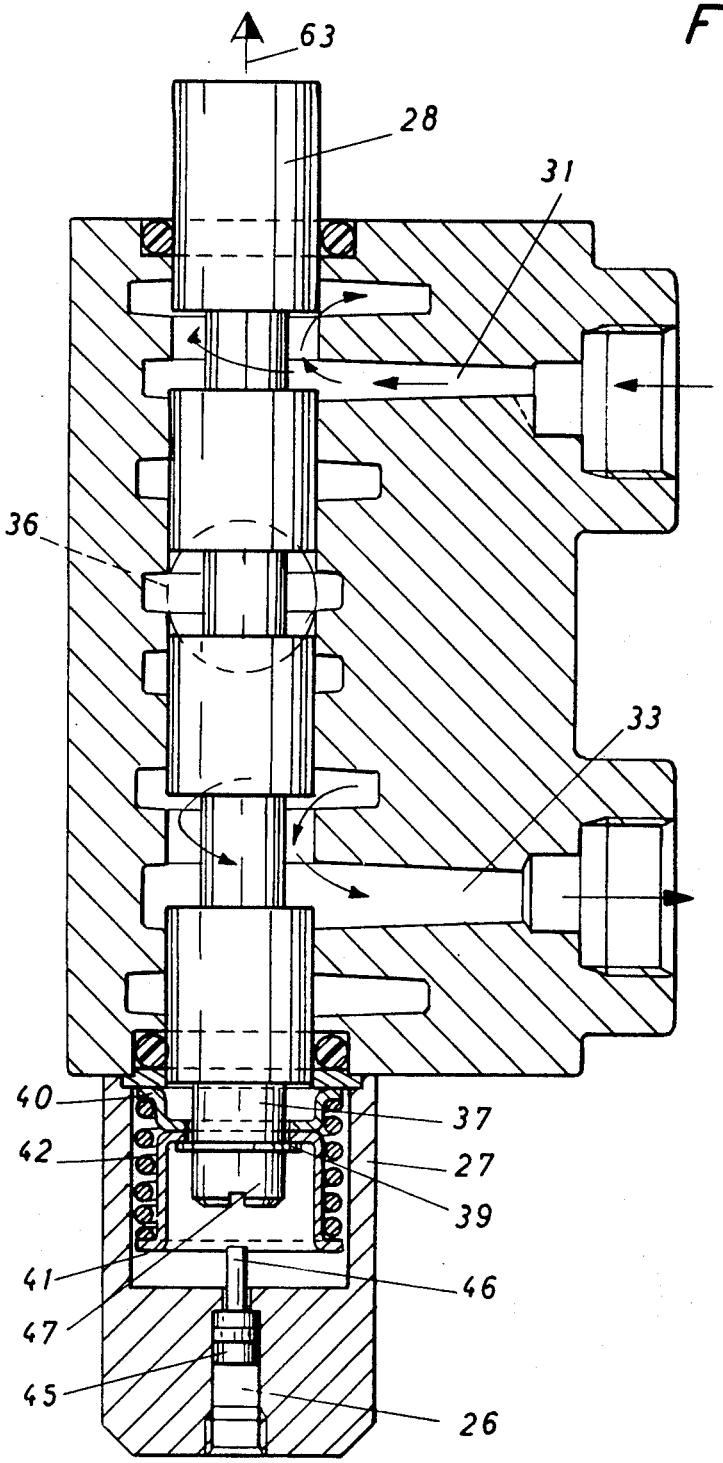

The three operating valves 19, 20, and 21 are mutually identical. FIGS. 3–5 illustrate the operating valve 21 for the extension arm 6. The line 29 is connected at its one end to the end 30 of the cylinder 14 remote from the loading hook supporting end of the arm 6, and the opposite end is coupled to the point of connection 31 in the valve housing 27. A line 32 has its one end connected to the outer end 33 of the cylinder 14 and the opposite end to the point of connection 34. A line 35 has its one end connected to the point of connection 36 on the valve housing 27 and debouches at its opposite end into the liquid reservoir 17. At the outer end of a trunnion 37 on the operating valve piston 28 is attached, by means of a bolt 38, a washer 39 serving as a stop means for two washers 40, 41 mounted for displacement on the trunnion 37, a helical spring 42 being held between said two washes 40, 41, so as to tend to keep the valve piston 28 in the intermediate position illustrated in FIG. 4, in which position liquid passage to the points of connection 31 and 34 is interrupted, see piston surfaces 43 and 44, respectively. A piston 45, denominated return piston, is axially displaceable in the cylinder 26 and is provided with an axially extending prolongation pin 46 serving to abut against and to exert pressure on the head 47 of the bolt 38.

A line 48 is connected to the interior of the valve housing 49 of the two-way valve 24, and the opposite end of said line debouches into the liquid reservoir 17. The valve body 50 of the two-way valve has at its lower end an axially extending channel 51 debouching at its bottom adjacent the valve housing 49 and at its top merging into a crosswise extending channel 52 in the piston 50. A similar, axially extending channel 53 is arranged in the upper end of the piston 50. Said channel 53 debouches into the valve housing 49 and merges at its bottom into a crosswise channel 54. The valve housing 49 is provided on its internal surface with two peripherally extending channels 55, 56 which are spaced some distance apart and which are connected to lines 23 and 25, respectively. Longitudinal channels 57, provided in the piston 50, permit communication between the peripheral channels 55 and 56 when the piston is in its uppermost position (FIG. 2) in which a helical spring 60, held between a plate 58 on the upper piston end and the upper end 59 of the valve housing 49, is compressed and the plate 58 abuts against the lower end of an axial stop pin 61 in the interior of the valve housing.

Should, during operation of the crane, the liquid pressure in line 22 to the master cylinder 9 tend to exceed a certain, predetermined maximum value *p* as a result of a heavy load supported in the hook 7 having been moved by the extension arm 6 to a position too far away from the post 1 and the moment of loading consequently exceeding the maximum permissible value — the pressure in line 23 also rises and the pressure propagates through channel 51 in the piston 50 of the two-way valve 24 down to the lower closed end of the valve housing 49. As a result, the piston 50 will be displaced upwards while compressing the spring 60, until the plate 58 abuts against the lower end of the pin 61. Pressurized liquid will then be forced from line 23 via the peripheral channel 55, crosswise extending channel 52, the longitudinal channels 57, the peripheral channel 56 and the line 25 to the cylinder 26, the pressure increase in the latter resulting in a movement inwards of the piston 45 to displace the operating valve piston 28 from the end position illustrated in FIG. 3 (to which it has been moved following actuation from a control lever, not shown but indicated by arrow 62 in FIG. 3), to the intermediate position shown in FIG. 4 with the aid of the helical spring 42. In the intermediate position liquid supply to the extension arm cylinder 14 is interrupted for which reason it is no longer possible to move arm 6 outwards. In the same manner valve piston 28 in the operating valve 19 is moved to the intermediate position and thus interrupts supply of pressurized liquid through line 22 to the master cylinder 9. Consequently, there is no possibility to further increase the value of the moment of loading. On the other hand, it is possible to use the control levers or any equivalent controls to move the valve piston 28 to its opposite end position, see arrow 63 in FIG. 5, in which position supply of pressurized liquid to the cylinder 14 is again made possible although in the reverse direction such that the arm 6 with the load supported thereon in the hook 7 may be moved closer to the post 1, i.e. the moment of loading is brought to a value below the maximum permissible value. The pressure in line 22 and in line 23 to the two-way valve 24 is then reduced sufficiently to permit the spring 60 to return piston 50 to its original position (FIG. 1) in which supply of pressurized liquid through line 25 to the cylinders 26 of the respective operating valves 19, 20, and 21 is closed off. Instead, the pressurized liquid in the respective ones of cylinders 26 may be drained off through lines 25, the peripheral channels 56, the transverse channels 54, the axial channels 53 and lines 48 to the collection reservoir 17. This makes it possible to return the valve pistons 28 of operating valves 19, 20, 21 to the end position illustrated in FIG. 3 by means of the associated operating levers to render possible resumption of the normal work of the crane.

Figure 6:
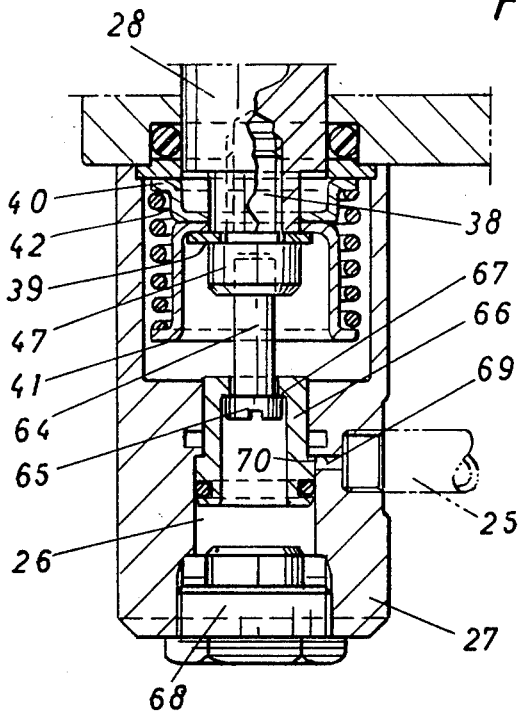
FIGS. 6 and 7 are similar longitudinal sections through one end of the operating valve in accordance with an alternative embodiment of the invention and illustrate the valve piston in two different positions thereof.
Figure 7:
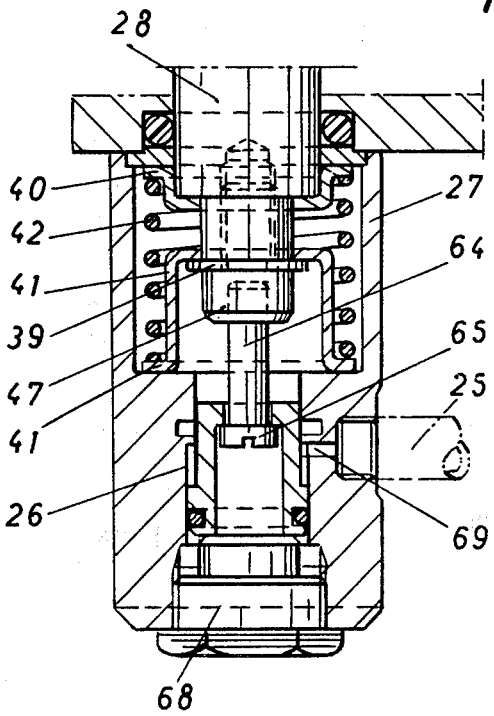

FIGS. 6 and 7 show a modified type of a return device which completes and in some cases replaces the return device in accordance with FIGS. 3–5, viz. in cases when the operating valves on the opposite side are blocked by means of e.g. manual controls.

A bolt 64 is screwed into the head 47 of the bolt 38, the head 65 of said bolt being positioned inside a tubular slide 66 which is axially displaceable in the cylinder 26 and has an abutment surface 67 at its inner end. The outer end of the cylinder 26 is closed by means of a screw plug 68. Line 25 is connected to the valve housing 27 at a point 69 positioned just inside a peripheral flange 70 on the slide 66.

Upon occurrence of the above-mentioned pressure rise in line 29 the slide 66 is urged axially outwards (downwards with reference to the drawing), bringing along with it the bolt 64 and thus also the valve piston 28 from the upper end position thereof — in which in this case normal functioning of the crane is possible — to the intermediate position shown in FIG. 7 in which position the flow of liquid to the cylinders 9, 11, and 14 is blocked. From the intermediate position the valve piston 28, when influenced for instance by a control lever, may be moved to its lower end position (not illustrated) to enable such working movements of the crane as permit only a decrease of the loading moment value.

The embodiments as shown and illustrated are to be regarded as examples only and various parts of the crane, particularly the construction and formation of the operating valves 18, 19, 20, and 21 as also the construction of the return device may be altered in a variety of ways within the scope of the appended claims. It is likewise possible to apply the invention to other types of cranes than the one illustrated in the drawings. The invention thus embraces also a crane wherein the loading boom 3 consists of a single arm, one end of which is rotatably mounted in the crane post 1 and wherein the extension arm 6 is arranged on said single boom so as to be prolonged relative thereto.

In the aforegoing and in the accompanying figures, the return piston 45 has been shown to work directly on the sliding member of the operating valve. The transfer of movement from the return position to the sliding member of the operating valve may, however, be carried out also through a mechanical element coupled between said two elements. Above all, this application permits the return piston to be attached in a simple manner on the operating rods of existing cranes and the movement thus to be transmitted mechanically from the return piston to the operating valve sliding member. It is thus possible to mount the return piston together with the valve unit in such a way that either directly or via mechanical transmittance it may bring about return of the operating piston to the neutral position while at the same time blocking the operating positions of the operating piston in question.

What I claim is:

1. A hydraulically operated crane including a vertically swingable boom having an extension adapted to carry a load, a first piston-cylinder arrangement adapted to raise and lower said boom, and a further piston-cylinder arrangement adapted to project and retract said extension whereby the moment arm loading on said boom is altered principally incident to such projection and retraction of the extension;

a first control valve means for selectively operating said first piston-cylinder arrangement;

a further control valve means for selectively operating said further piston-cylinder arrangement, and including a control member having an intermediate position in which operation of said further piston-cylinder arrangement is blocked, a first operative position on one side of said intermediate position in which said extension is moved in projecting direction, and a second operative position on the other side of said intermediate position in which said extension is moved in retracted direction; and actuator means connected to that side of said first piston-cylinder arrangement which takes up said moment arm loading for forcing said control member from said first operative position thereof to said intermediate position thereof in response to moment arm loading exceeding a predetermined value.

2. A hydraulically operated crane as defined in claim 1 including a one-way connection between said actuator means and said control member permitting unhindered operation of said control member to said second operative position thereof whereby to allow retraction of said extension and decrease in the moment arm loading on the boom.

3. A hydraulically operated crane as defined in claim 2 wherein said first control valve means also includes a control member having an intermediate position in which swinging movement of the boom is blocked, a first operative position in which said boom swings upwardly and a second operative position in which said boom swings downwardly; said actuating means being also connected to said control member of the first control valve means to block upwad swinging of said boom when said predetermined value of moment arm loading is reached.

4. A hydraulically operated crane as defined in claim 1 wherein said first control valve means also includes a control member having an intermediate position in which swinging movement of the boom is blocked, a first operative position in which said boom swings upwardly and a second operative position in which said boom swings downwardly; said actuating means being also connected to said control member of the first control valve means to block upward swinging of said boom when said predetermined value of moment arm loading is reached.

5. A hydraulically operated crane as defined in claim 1 wherein said control member comprises an axially shiftable valve piston and said actuating means comprises a return piston-cylinder arrangement aligned with said valve piston.

6. A hydraulically operated crane as defined in claim 5 wherein the piston of said return piston-cylinder arrangement is adapted to abut said valve piston.

7. A hydraulically operated crane as defined in claim 5 including lost motion connection means coupling the piston of said return piston-cylinder arrangement to said valve piston.

8. In a hydraulically operated crane as defined in claim 12 wherein said first piston-cylinder arrangement adapted to raise and lower said boom includes means for swinging the boom in a vertical plane.

9. In a hydraulically operated crane as defined in claim 8 wherein said control valve means comprises a first valve associated with said first piston-cylinder arrangement and a further valve associated with said further piston-cylinder arrangement; said control member means comprises an axially shiftable first valve piston associated with said first valve and an axially shiftable further valve piston associated with said further valve; and said actuator means comprises a first return piston-cylinder arrangement aligned with said first valve piston and a further return piston-cylinder arrangement aligned with said further valve piston.

10. In a hydraulically operated crane as defined in claim 9 wherein the piston of said firstreturn piston-cylinder arrangement and the piston of said further return piston-cylinder arrangement respectively are adapted to abut said first valve piston and said further valve piston.

11. In a hydraulically operated crane as defined in claim 9 including first lost motion connecting means coupling the piston of said first return piston-cylinder arrangement to said valve piston and further lost motion connection means coupling the piston of said further return piston-cylinder arrangement to said further valve piston.

* * * * *